US008584843B2

(12) United States Patent
Hillard

(10) Patent No.: US 8,584,843 B2
(45) Date of Patent: Nov. 19, 2013

(54) PACKAGE SYSTEM FOR PARTICULATE ORGANIC PRODUCT

(76) Inventor: Robert Hillard, Rolling Hills, CA (US)

( * ) Notice: Subject to any disclaimer, the term of this patent is extended or adjusted under 35 U.S.C. 154(b) by 0 days.

(21) Appl. No.: 13/413,237

(22) Filed: Mar. 6, 2012

(65) Prior Publication Data

US 2013/0233743 A1 Sep. 12, 2013

(51) Int. Cl.

| | |
|---|---|
| ***B65D 69/00*** | (2006.01) |
| ***B65D 85/00*** | (2006.01) |
| ***B65D 25/04*** | (2006.01) |
| ***B65D 5/38*** | (2006.01) |
| ***B65D 5/49*** | (2006.01) |

(52) U.S. Cl.
USPC ..... 206/237; 206/268; 206/273; 229/120.11; 229/120.37; 229/125.125

(58) Field of Classification Search
USPC ..... 206/237, 242, 264–268, 271–275; 229/120.01, 120.02, 120.11, 120.18, 229/120.37, 162.1
See application file for complete search history.

(56) References Cited

U.S. PATENT DOCUMENTS

| | | | | | |
|---|---|---|---|---|---|
| 944,954 | A * | 12/1909 | Davis | 229/125.125 |
| 1,045,366 | A * | 11/1912 | Bjelland | 206/237 |
| 1,506,926 | A * | 9/1924 | Clarke | 206/237 |
| 1,790,370 | A * | 1/1931 | Earman | 206/267 |
| 1,821,472 | A * | 9/1931 | McCrosson | 206/274 |
| 2,011,399 | A * | 8/1935 | Driscoll | 206/237 |
| 2,015,278 | A * | 9/1935 | Meyer | 229/120.18 |
| 2,643,811 | A * | 6/1953 | Bolding | 229/162.1 |
| 2,951,625 | A * | 9/1960 | Marban | 229/125.125 |
| 3,317,033 | A * | 5/1967 | Walker | 206/268 |
| 3,563,449 | A * | 2/1971 | Forbes, Jr. | 229/120.18 |
| 3,664,569 | A * | 5/1972 | Dock | 206/236 |
| 6,702,108 | B2 * | 3/2004 | Lo Duca | 229/120.18 |
| 8,235,204 | B2 * | 8/2012 | Loughman et al. | 206/267 |
| 2011/0220657 | A1 * | 9/2011 | Walling | 229/120.02 |

OTHER PUBLICATIONS

Photos and graphics (submitted herewith as Prior Box 1) of an example prior art box in accordance with the prior art discussed in paragraph [0003] of the present patent application.
Photos and graphics (submitted herewith as Prior Box 2) of an example prior art box in accordance with the prior art discussed in paragraph [0003] of the present patent application.

* cited by examiner

*Primary Examiner* — Bryon Gehman
(74) *Attorney, Agent, or Firm* — Lance M. Pritikin

(57) ABSTRACT

At least one embodiment of a package system for particulate organic product includes a box element and an insert element. The box element generally includes a side pocket for retaining an auxiliary packet, such as a packet of cigarette rolling papers. The insert element acts as a transparent window aligned with one or more window apertures in the first face panel of the box element, and is extendable from the box element to provide a tray which can be partitioned into a product measurement zone and a product retentions zone. The partitioning may be provided by a foldable closure panel and associated tuck flap acting in cooperation with one another. The box element and insert element may be formed from respective pre-cut and scored blanks.

20 Claims, 6 Drawing Sheets

PACKAGE SYSTEM FOR PARTICULATE ORGANIC PRODUCT

TECHNICAL FIELD

The present invention relates generally to disposable packaging systems. More particularly, the present invention relates to small, box-type packaging systems for containing and dispensing particulate organic product.

BACKGROUND

Organic smokable product, such as tobacco, legal non-tobacco herbs, or the like, continues to be enjoyed by consumers worldwide. Optimizing the smoking characteristics of organic material requires maintaining its freshness and flocculence from the time the product is packaged until the time the consumer uses the product. Protecting the freshness of the product helps maximize its flavor and burn characteristics at the time of its use. Protecting the flocculence, or fluffiness, of an aggregate of particulate smokable product helps ensure that, when placed in rolling paper, leaf or other cigar wrapper material by the consumer, it will draw properly and thereby produce a smoother smoking experience.

Personal sized box systems have been proposed within which such organic product is sold and conveniently carried by an individual consumer until such product is fully dispensed. Some such systems may include a window through which the organic product can be viewed, and may include a side pocket within which rolling papers may be stored. However, such conventional systems may not provide aspects for conveniently allowing a consumer to measure out a desired quantity of the product prior to placement of the measured quantity onto a rolling paper, and may not adequately prevent an excessive amount of the product from escaping from the box. A lack of continuous or adequate rigidity in such conventional systems may also result in deficient securement and protection of the rolling papers held within the side pocket.

What is needed is a package system for organic product with a box having a window and a side pocket, wherein the box can be formed more inexpensively from a box blank while generally providing improved rigidity over prior solutions. The resulting system should also provide the consumer the ability to more conveniently dispense a desired amount of product from the box for a single use, while reducing spillage of the remaining product or unnecessary reduction in its freshness or flocculence. Those in the art appreciate that these and other desired objectives addressed by embodiments of the invention described herein are preferably accomplished while minimizing the number of individual components of the system and the manufacturing costs and processes involved in producing such a system.

SUMMARY

One or more deficiencies of the prior art are addressed by a package system for particulate organic product, which typically includes at least a box element and an insert element. The organic product may be, for example, tobacco, non-tobacco herbs, a combination thereof, or the like.

The box element may include a first face panel, a second face panel, a box cavity therebetween and a side pocket. The box cavity may have a first end and a second end. The first face panel may include a window aperture. The second face panel may include a tenth fold line at generally the second end. The box element may further include a second closure panel extending along the tenth fold line and a second tuck flap foldedly connected to the second closure panel generally oppositely of the tenth fold line. The box element may be formed from a box blank particularly configured to provide the resulting box element with improved structural properties while minimizing manufacturing-related costs and complexities.

The insert element may be substantially transparent and slideable with respect to the box cavity between a retracted configuration and an extended configuration. The insert element is typically positioned entirely within the box cavity when in its retracted configuration. Contrastingly, the insert element typically extends partially outwardly of the second end when in its extended configuration. The second closure panel and second tuck flap may be cooperatively movable into a product partitioning configuration in which the second closure panel and second tuck flap may act as a product partition when the insert element is in its extended configuration, thereby separating a product measurement zone from a product retention zone. Once a consumer has selectively measured and partitioned a quantity of the product within the product measurement zone, the system may be tilted to allow the measured quantity to be conveniently dispensed from the product measurement zone while the remaining product is retained within the product retention zone, where its flocculence, purity and freshness may be substantially preserved.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
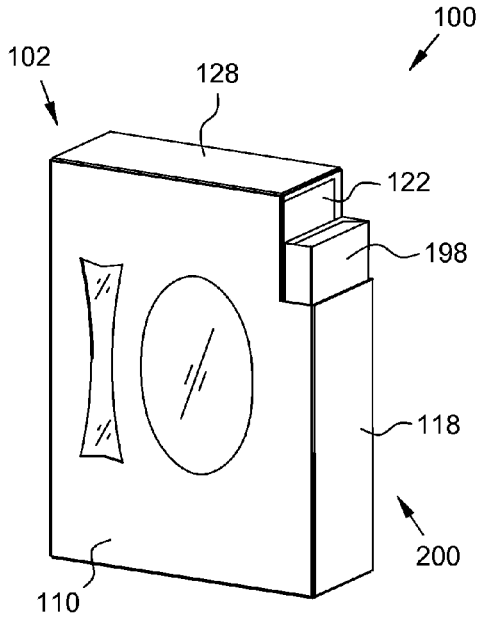
FIG. 1 is a diagrammatic perspective view of an embodiment of a package system in accordance with the present invention.
Figure 2:
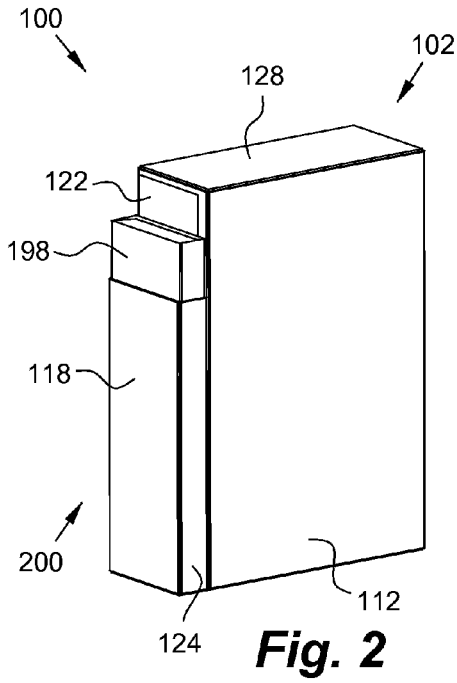
FIG. 2 is a further diagrammatic perspective view of the embodiment shown in FIG. 1.

Referring now to the drawings, like reference numerals designate identical or corresponding features throughout the several views. Embodiments of a package system for organic product are shown generally at 100, and may include a box element 102 and an insert element 104. The box element 102 is typically formed to include an integral side pocket 200 adapted to snuggly and protectively receive an auxiliary packet (such as the one illustrated, for example, at 198). The auxiliary packet may comprise or contain, for example, fresh rolling papers.

A box blank 106 may be provided for forming a box element 102 with integral side pocket 200. The box blank 106 may be made of a foldable material such as, for example, paperboard or the like. The box blank 106 may include decorative and informative printing, and fold lines which may be defined by, for example, scoring of the material of which the blank is substantially made. Embodiments of a box blank 106 may comprise a first face panel 110, a second face panel 112, a first side panel 114, a second side panel 116, a pocket side panel 118, a first adhesion flap 120, a second adhesion flap 122, a pocket face panel 124, and a pocket closure flap 138.

The first face panel 110 may be defined at least in part by a first fold line 148, a second fold line 150 and a third fold line 152. The first and second fold lines may be generally parallel to the third fold line 152 and disposed at a first distance 190 and a second distance 192 respectively therefrom. The first distance 190 may be greater than the second distance 192 by a third distance 194. In certain preferred embodiments, the third distance 194 may be, for example, approximately 0.3 inches. In certain preferred embodiments, the first face panel 110 may include one or more window apertures 140.

The first side panel 114 may be defined at least in part by the third fold line 152 and a fifth fold line 156 generally parallel thereto. The pocket side panel 118 may be defined at least in part by the first fold line 148 and a sixth fold line 158 generally parallel thereto. The pocket face panel 124 may be defined at least in part by the sixth fold line 158 and a seventh fold line 160 generally parallel thereto. The sixth and seventh fold lines may be spaced from one another by approximately the third distance 194. The first adhesion flap 120 may be foldably connected to the pocket face panel 124 along the seventh fold line 160. The second adhesion flap 122 may be foldably connected to the second fold line 150, and may be separated from the pocket side panel 118 by way of an adhesion flap slit 188. The second face panel 112 may be defined at least in part by the fifth fold line 156 and an eighth fold line 162 generally parallel thereto. The second side panel 116 may be foldably connected to the second face panel 112 along the eighth fold line 162. The pocket closure flap 138 may be foldably connected to the pocket side panel 118 along a ninth fold line 164. The ninth fold line 164 may be generally perpendicular to the first fold line 148.

In particular embodiments of a box blank 106, the first face panel 110 may be further defined by a fourth fold line 154 which may extend generally from the third fold line 152 to the first fold line 148. In such embodiments, the second face panel 112 may be further defined by a tenth fold line 166 generally perpendicular to the third fold line 152. The box blank 106 may further comprise a first closure panel 126, a second closure panel 128, a first tuck flap 134 and a second tuck flap 136. The first closure panel 126 may extend along the fourth fold line 154 from, for example, approximately the first fold line 148 to the third fold line 152. The second closure panel 128 may extend along the tenth fold line 166 from, for example, approximately the fifth fold line 156 to the eighth fold line 162. The first tuck flap 134 may be foldably connected to the first closure panel 126 along an eleventh fold line 168 and may extend, for example, generally within the second distance 192 generally along the eleventh fold line 168. The first tuck flap 134 maybe partially disconnected from the first closure panel 126 by way of a pair of laterally opposed tuck flap slits 186. The second tuck flap 136 may be foldably connected to the second closure panel 128, for example, along a sixteenth fold line 178.

A first dust flap 130 and a second dust flap 132 may be foldably connected to opposite ends of the first side panel 114 by way of, for example, a twelfth fold line 170 and thirteenth fold line 172, respectively. Similarly, a further first dust flap 130 and second dust flap 132 may be foldably connected to opposite ends of the second side panel 116 by way of, for example, a fourteenth fold line 174 and a fifteenth fold line 176, respectively.

Certain embodiments of a package system 100 for organic product may comprise a box element 102 made of a foldable material, such as, for example, paperboard or the like. The box element 102 may include a first face panel 110, a first side panel 114, a pocket side panel 118, a pocket face panel 124, a first adhesion flap 120, a second adhesion flap 122, a second face panel 112, a second side panel 116 and a pocket closure flap 138.

In such embodiments of a box element 102, the first face panel 110 may be defined at least in part by a first fold line 148, a second fold line 150, and a third fold line 152. The first and second fold lines may be generally parallel to the third fold line 152 and may be disposed at a first distance 190 and a second distance 192 respectively therefrom. The first distance 190 may be greater than the second distance 192 by a third distance 194. In certain embodiments, the third distance 194 may be, for example, approximately 0.3 inches.

Figure 10:
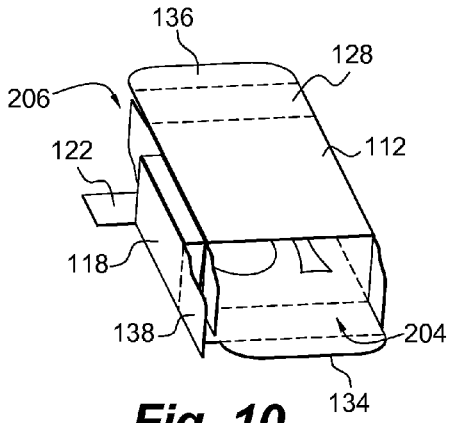
FIG. 10 is a diagrammatic perspective view of a fourth intermediate precursor of the box element shown in FIG. 1, in which the formation of the box element is further advanced from the precursor of FIG. 9, illustrating the first adhesion flap having been adhesively bonded to the second side panel.
Figure 11:
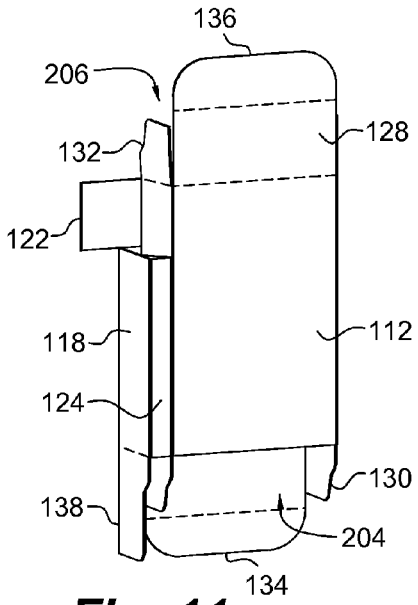
FIG. 11 is a further diagrammatic perspective view of the fourth intermediate precursor shown in FIG. 10.
Figure 12:
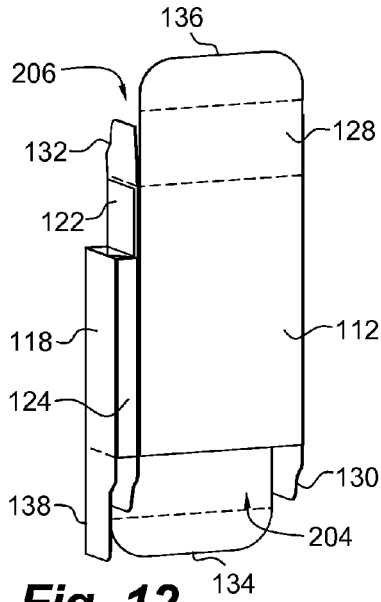
FIG. 12 is a diagrammatic perspective view of a fifth intermediate precursor of the box element shown in FIG. 1, in which the formation of the box element is further advanced from the precursor of FIG. 10, illustrating the second adhesion flap having been adhesively bonded to the second side panel.
Figure 13:
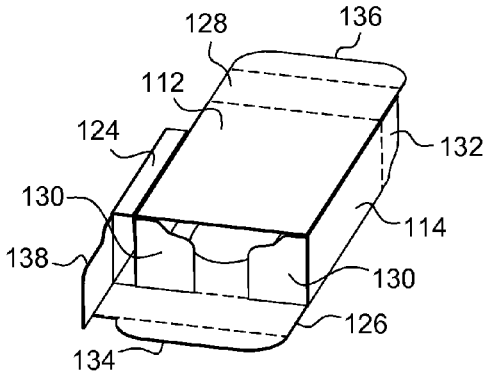
FIG. 13 is a diagrammatic perspective view of a sixth intermediate precursor of the box element shown in FIG. 1, in which the formation of the box element is further advanced from the precursor of FIG. 12, illustrating the first dust flaps having been folded inwardly.
Figure 14:
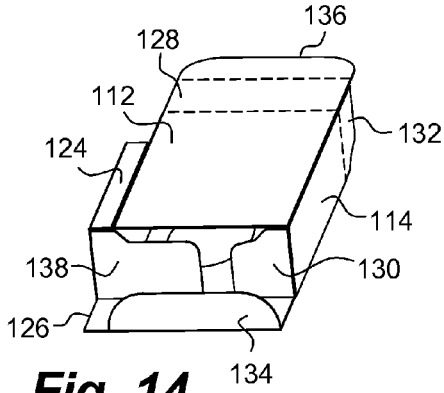
FIG. 14 is a diagrammatic perspective view of a seventh intermediate precursor of the box element shown in FIG. 1, in which the formation of the box element is further advanced from the precursor of FIG. 13, illustrating the pocket closure flap having been folded inwardly.
Figure 15:
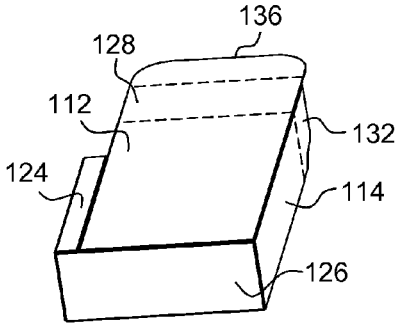
FIG. 15 is a diagrammatic perspective view of an eighth intermediate precursor of the box element shown in FIG. 1, in which the formation of the box element is further advanced from the precursor of FIG. 14, illustrating the first closure panel having been folded with respect to the first face panel and the first tuck flap inserted into the box cavity.

The first side panel 114 of the box element 102 may be defined at least in part by the third fold line 152 and a fifth fold line 156 generally parallel thereto. The pocket side panel 118 may be defined at least in part by the first fold line 148 and a sixth fold line 158 generally parallel thereto. The pocket face panel 124 may be defined at least in part by the sixth fold line 158 and a seventh fold line 160 generally parallel thereto. The sixth and seventh fold lines may be spaced from one another by approximately the third distance 194. The first adhesion flap 120 may be foldedly connected to the pocket face panel 124 along the seventh fold line 160. The second adhesion flap 122 may be foldedly connected to the second fold line 150. The second face panel 112 may be defined at least in part by the fifth fold line 156 and an eighth fold line 162 generally parallel thereto. The second side panel 116 may be foldedly connected to the second face panel 112 along the eighth fold line 162. The pocket closure flap 138 may be foldedly connected to the pocket side panel 118 along a ninth fold line 164. The ninth fold line 164 may be generally perpendicular to the first fold line 148. As illustrated, for example, in FIGS. 10 and 11, each pair of aforementioned panels which are defined at least in part by a common one of the aforementioned fold lines may be at an approximately right angle with respect to one another, the box element 102 thereby defining a box cavity 202 therein and a side pocket 200.

In certain embodiment of a package system 100 with a box element 102, the first face panel 110 may be further defined by a fourth fold line 154 extending generally from the third fold line 152 to the first fold line 148. In addition, the second face panel 112 may be further defined by a tenth fold line 166 generally perpendicular to the third fold line 152. The box element 102 may further comprise a first closure panel 126, a second closure panel, a first tuck flap and a second tuck flap. The first closure panel 126 may extend along the fourth fold line 154 from approximately the first fold line 148 to the third fold line 152. The second closure panel 128 may extend along the tenth fold line 166 from approximately the fifth fold line 156 to the eighth fold line 162. The first tuck flap 134 may be foldedly connected to the first closure panel 126 along an eleventh fold line 168 and may extend generally within the second distance 192 generally along the eleventh fold line 168. The second tuck flap 136 may be foldedly connected to the second closure panel 128.

In particular embodiments of a box element 102, the first face panel 110 may include at least one window aperture 140. Such window apertures may, for example, take the form of decoratively or alpha-numerically-shaped designs. In embodiments of a box element 102, the first adhesion flap 120 and second adhesion flap 122 may each be adhesively bonded to the second side panel 116. For example, the first adhesion zone 180 of the first adhesion flap 120 may be brought into mutual adhesive contact with the second adhesion zone 182 of the second side panel 116. Similarly, the backside of the second adhesion flap 122 may be brought into mutual adhesive contact with the third adhesion zone 184 of the second side panel 116.

Figure 3:
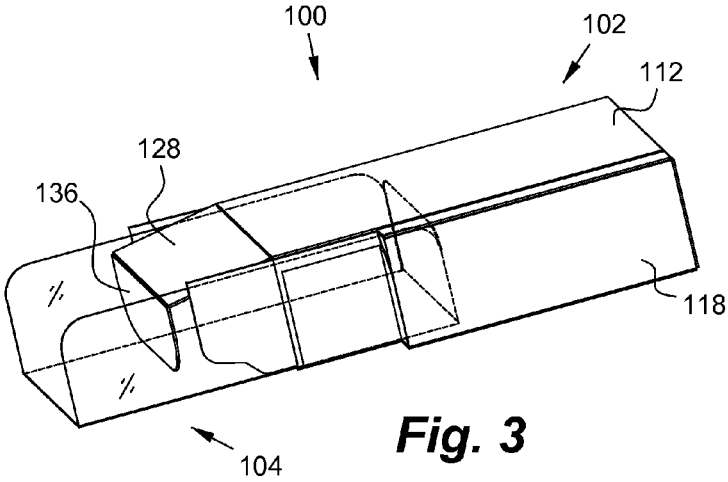
FIG. 3 is a diagrammatic perspective view of the embodiment of FIG. 1 wherein the insert element is shown partially extended from the box element, the second tuck flap is at least partially folded with respect to the second closure panel, and the second closure panel is at least partially unfolded with regard to the second face panel, thereby defining a measurement zone for dispensing a measured quantity of organic product from the box element.
Figure 16:
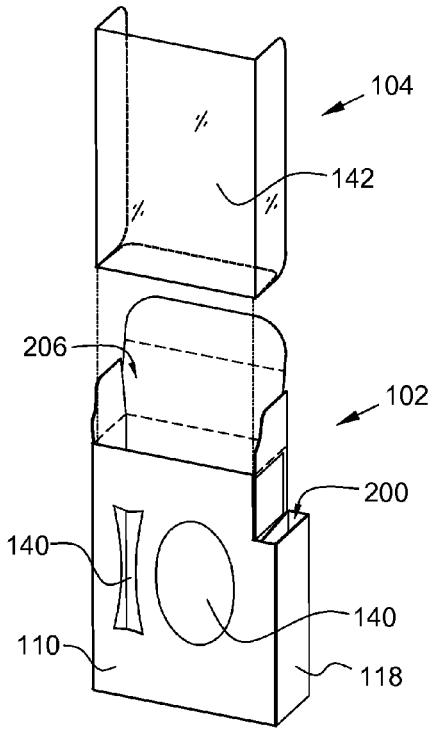
FIG. 16 is a diagrammatic perspective view of the package system in which the insert element is in the process of being slideably inserted into the box cavity such that the insert end panel will be positioned substantially adjacent to the first closure panel.
Figure 17:
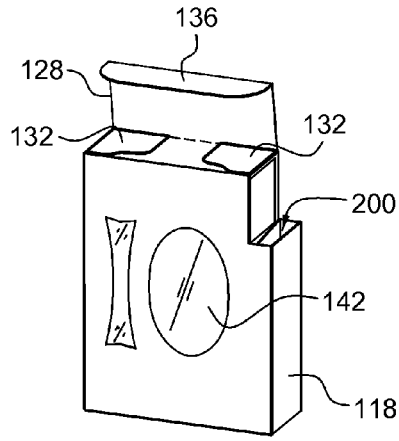
FIG. 17 is a diagrammatic perspective view of the package system shown in FIG. 16, but in which the insert element is shown slideably removably received within the box cavity such that the insert base panel extends across the window aperture of the box element.
Figure 18:
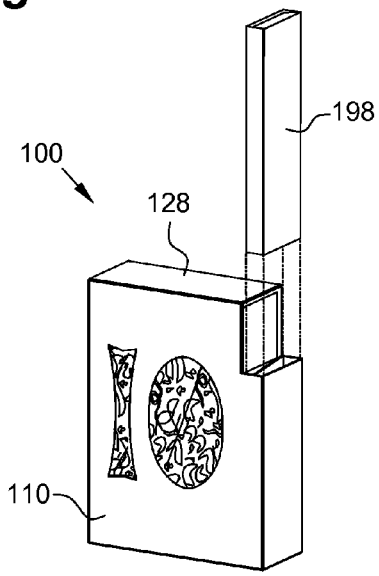
FIG. 18 is a diagrammatic perspective view of the package system shown in FIG. 17, but in which an auxiliary packet of rolling papers is being inserted into the side pocket of the box element.
Figure 19:
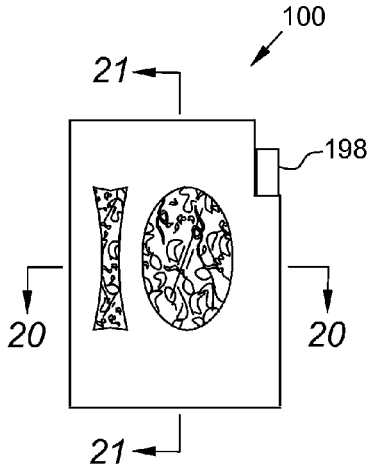
FIG. 19 is a diagrammatic front view of the package system shown in FIG. 18, but in which the box element contains organic smokable product and an auxiliary packet of rolling papers is fully inserted into the side pocket of the box element.
Figure 20:
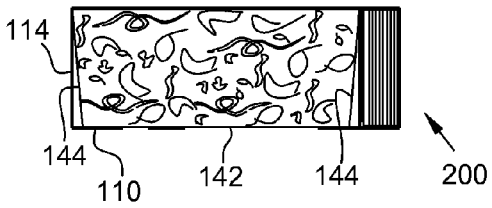
FIG. 20 is a diagrammatic cross-sectional view taken along line 20-20 in FIG. 19.

As illustrated, for example, in FIGS. 3 and 16, embodiments of a package system 100 may further comprise an insert element 104. Turning to FIG. 5, an insert element 104 may include, for example, an insert base panel 142, a pair of insert lateral panels 144 oppositely disposed from one another, and an insert end panel 146. The insert lateral panels 144 and insert end panel 146 may be in folded engagement with the insert base panel 142. The insert element 104 may be substantially light permeable and slideably removably received within the box cavity 202. As illustrated, for example, in FIG. 4, certain preferred embodiments of an insert element 104 may be formed substantially from an insert blank 108. The insert element 102 and related insert blank 108 may be made, for example, substantially of a polymer or similar material.

In embodiments of a package system 100 in which an insert element 104 is in a fully inserted configuration with respect to the box cavity 202, the insert end panel 146 may be substantially adjacent the first closure panel 126 and may also be approximately parallel therewith. In certain embodiments of a package system 100 in which the first face panel includes at least one window aperture 140, the insert base panel 142 may extend across the at least one window aperture 140. Such embodiments may further comprise organic smokable product 214 within the box cavity 202, wherein the insert base panel 142 is substantially disposed between the organic smokable product 214 and the at least one window aperture 140.

Figure 4:
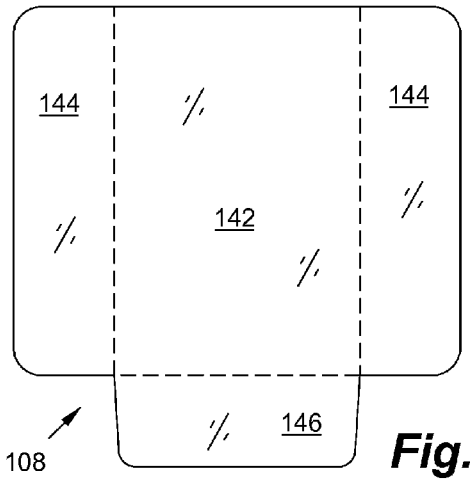
FIG. 4 is a diagrammatic plan view of one particular example of an insert blank in accordance with the present invention, in which the insert base panel and insert side panels are shown in unfolded engagement with the insert base panel.
Figure 5:
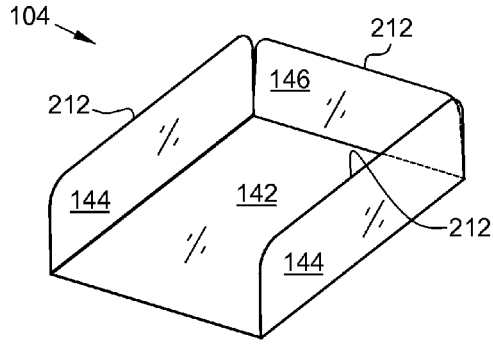
FIG. 5 is a diagrammatic perspective view top view of one particular example of an insert element in accordance with the present invention, in which the insert base panel, and insert side panels are shown in folded engagement with the inset base panel.
Figure 6:
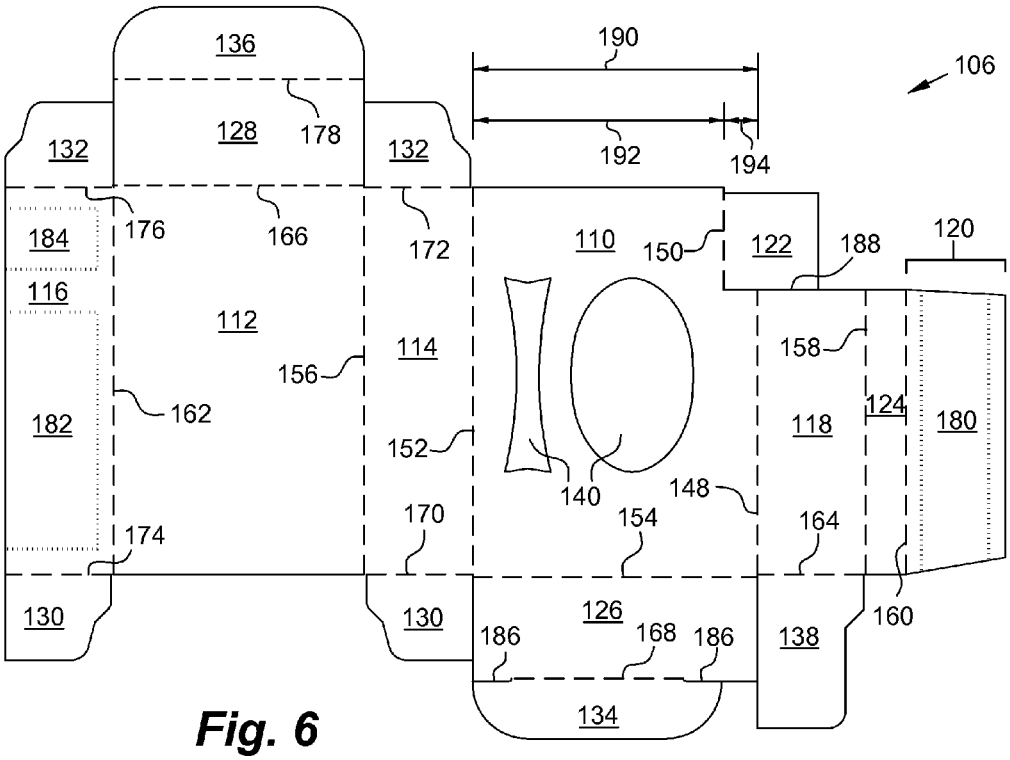
FIG. 6 is a diagrammatic plan view top view of one particular example of a box blank in accordance with the present invention.
Figure 7:
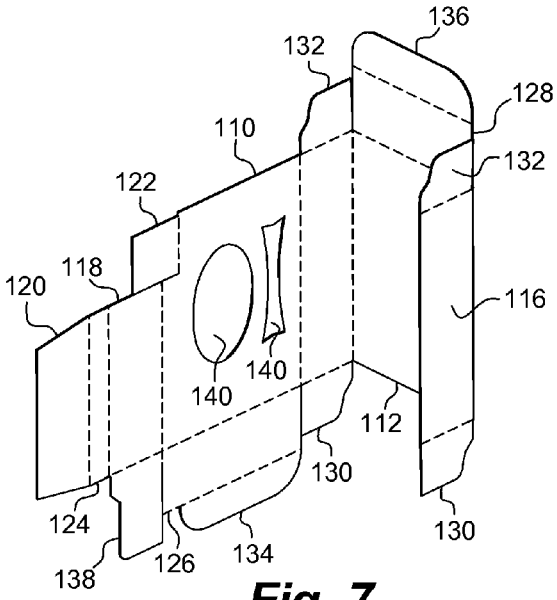
FIG. 7 is a diagrammatic perspective view of a first intermediate precursor of the box element shown in FIG. 1 having been formed from the box blank shown in FIG. 6.
Figure 8:
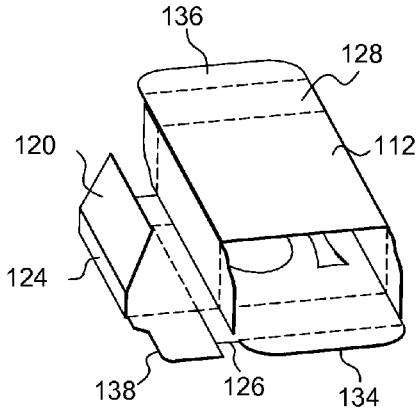
FIG. 8 is a diagrammatic perspective view of a second intermediate precursor of the box element shown in FIG. 1, in which the formation of the box element is further advanced from the precursor of FIG. 7.
Figure 9:
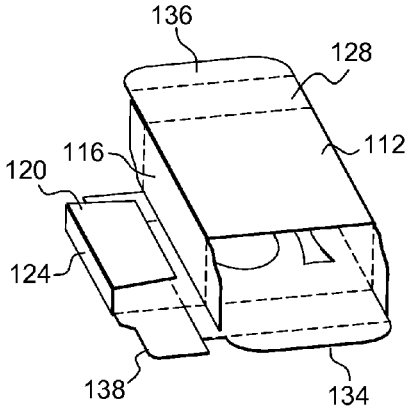
FIG. 9 is a diagrammatic perspective view of a third intermediate precursor of the box element shown in FIG. 1, in which the formation of the box element is further advanced from the precursor of FIG. 8.

In particular embodiments of a package system 100 having a box element 102 and an insert element 104, the insert lateral panels 144 may be elastically biased to return to a partially unfolded configuration (for example, respective positions between those shown in FIGS. 4 and 5). As a result, the respective outermost edges 212 may apply continuous pressure against the first side panel 114 and second side panel 116 when the insert element 104 is slideably received within the box cavity 202. The insert end panel 146 may be similarly elastically biased, but wherein it applies pressure to the first closure panel 126. This adaptation may help seal gaps between the outermost edges 212 and the respective portions of the box element 102, thereby helping prevent organic product from escaping from the box cavity 202 through a window aperture 140.

Certain embodiments of a package system 100 may comprise a box element 102 and an insert element 104. The box element 102 may include a first face panel 110, a second face panel 112, a box cavity 202 therebetween and a side pocket 200. The box cavity 202 may have a first end 204 and a second end 206. The first face panel 110 may include a window aperture 140. The second face panel 112 may include a tenth fold line 166 at generally the second end 206. The box element 102 may further include a second closure panel 128 extending along the tenth fold line 166 and a second tuck flap 136 foldedly connected to the second closure panel 128 generally oppositely of the tenth fold line 166.

Figure 21:
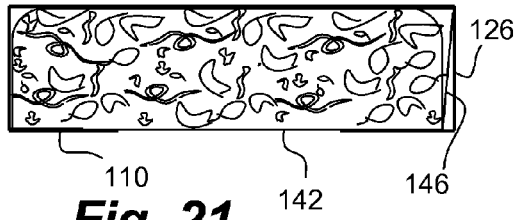
FIG. 21 is a diagrammatic cross-sectional view taken along line 21-21 in FIG. 19.
Figure 22:
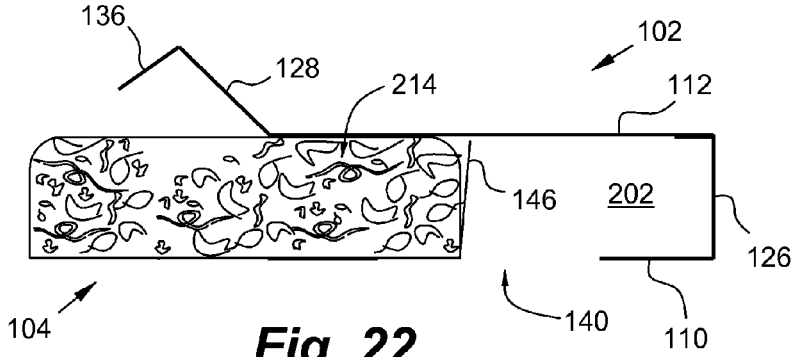
FIG. 22 is a further diagrammatic cross-sectional view taken along line 21-21 in FIG. 19, but in which the insert element is shown in an extended configuration.
Figure 23:
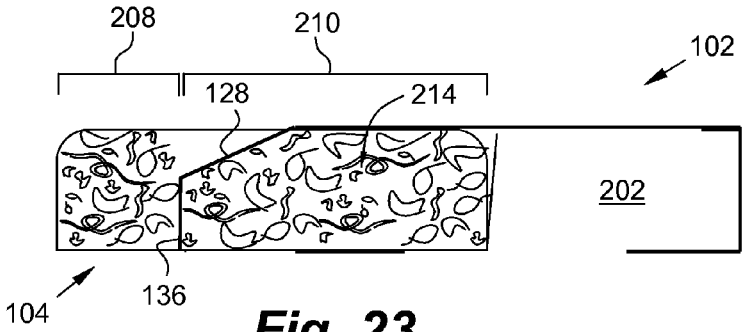
FIG. 23 is a diagrammatic cross-sectional view similar to that of FIG. 22, but in which the second closure panel and second tuck flap are shown cooperatively moved into a product partitioning configuration, thereby separating a product measurement zone from a product retention zone along the insert element.
Figure 24:
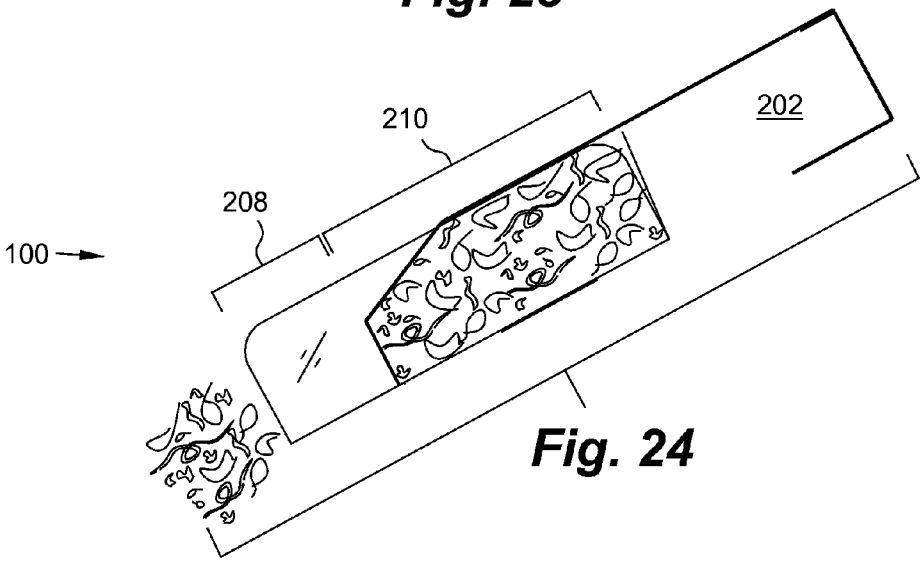
FIG. 24 is a diagrammatic cross-sectional view similar to that of FIG. 23, but in which the system has been tilted to allow a measured quantity of product to be gravitationally dispensed from the system while the remaining product is retained within the system.

The insert element 104 may be substantially transparent and slideable with respect to the box cavity 202 between a retracted configuration (as shown, for example, in FIG. 21) and an extended configuration (as shown, for example, in FIG. 22), thereby providing a convenient measurement and dispensing tray. The insert element 104 may be entirely within the box cavity 202 when in its retracted configuration. Contrastingly, the insert element 104 may be extending partially outward of the second end 206 when in its extended configuration. Referring to FIG. 23 for illustration, in such embodiments of a system 100, the second closure panel 128 and second tuck flap 136 may be cooperatively movable into a product partitioning configuration within which the second closure panel 128 and second tuck flap 136 may be adapted to separate a product measurement zone 208 from a product retention zone 210 along the insert element 104 when the insert element 104 is in its extended configuration. The system 100 configured as shown in FIG. 23 may then be tilted to allow a measured quantity of product to be dispensed, for example, gravitationally, from the product measurement zone 208 of the system while the remaining product is retained within the product retention zone 210 of the system.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A box blank for forming a box element with integral side pocket, said box blank being made of a foldable material and comprising:

a first face panel being defined at least in part by a first fold line, a second fold line and a third fold line, said first and second fold lines being generally parallel to said third fold line and disposed at a first distance and a second distance respectively therefrom, said first distance being greater than said second distance by a third distance;

a first side panel being defined at least in part by said third fold line and a fifth fold line generally parallel thereto;

a pocket side panel being defined at least in part by said first fold line and a sixth fold line generally parallel thereto;

a pocket face panel being defined at least in part by said sixth fold line and a seventh fold line generally parallel thereto, said sixth and seventh fold lines being spaced from one another by approximately said third distance;

a first adhesion flap foldably connected to said pocket face panel along said seventh fold line;

a second adhesion flap foldably connected to said second fold line;

a second face panel defined at least in part by said fifth fold line and an eighth fold line generally parallel thereto;

a second side panel foldably connected to said second face panel along said eighth fold line; and a pocket closure flap foldably connected to said pocket side panel along a ninth fold line, said ninth fold line being generally perpendicular to said first fold line.

2. A box blank as defined in claim 1 in which said foldable material is paperboard.

3. A box blank as defined in claim 1 in which said third distance is approximately 0.3 inches.

4. A box blank as defined in claim 1 in which said first face panel includes a window aperture.

5. A box blank as defined in claim 1 in which:

said first face panel is further defined by a fourth fold line, said fourth fold line extending generally from said third fold line to said first fold line;

said second face panel is further defined by a tenth fold line generally perpendicular to said third fold line; and said box blank further comprises a first closure panel extending along said fourth fold line from approximately said first fold line to said third fold line, a second closure panel extending along said tenth fold line from approximately said fifth fold line to said eighth fold line, a first tuck flap foldably connected to said first closure panel along an eleventh fold line and extending generally within said second distance generally along said eleventh fold line, and a second tuck flap foldably connected to said second closure panel.

6. A package system for organic product, said package system comprising:

a box element being made of a foldable material and including (a) a first face panel being defined at least in part by a first fold line, a second fold line, and a third fold line, said first and second fold lines being generally parallel to said third fold line and disposed at a first distance and a second distance respectively therefrom, said first distance being greater than said second distance by a third distance;

(b) a first side panel being defined at least in part by said third fold line and a fifth fold line generally parallel thereto;

(c) a pocket side panel being defined at least in part by said first fold line and a sixth fold line generally parallel thereto;

(d) a pocket face panel being defined at least in part by said sixth fold line and a seventh fold line generally parallel thereto, said sixth and seventh fold lines being spaced from one another by approximately said third distance;

(e) a first adhesion flap foldedly connected to said pocket face panel along said seventh fold line;

(f) a second adhesion flap foldedly connected to said second fold line;

(g) a second face panel defined at least in part by said fifth fold line and an eighth fold line generally parallel thereto;

(h) a second side panel foldedly connected to said second face panel along said eighth fold line; and (i) a pocket closure flap foldedly connected to said pocket side panel along a ninth fold line, said ninth fold line being generally perpendicular to said first fold line;

wherein each pair of said panels which are defined at least in part by a common one of said fold lines are at an approximately right angle with respect to one another, said box element thereby defining a box cavity therein and a side pocket.

7. A package system as defined in claim 6 in which said third distance is approximately 0.3 inches.

8. A package system as defined in claim 6 in which said first face panel includes at least one window aperture.

9. A package system as defined in claim 6 in which said first adhesion flap and said second adhesion flap are each adhesively bonded to said second side panel.

10. A package system as defined in claim 6 further comprising:

an insert element including an insert base panel, a pair of insert lateral panels oppositely disposed from one another, and an insert end panel, said insert lateral panels and said insert end panel being in folded engagement with said insert base panel, said insert element being substantially light permeable and slideably removably received within said box cavity.

11. A package system as defined in claim 10 in which said insert end panel is substantially adjacent said first closure panel and approximately parallel therewith.

12. A package system as defined in claim 10 in which said first face panel includes at least one window aperture, and said insert base panel extends across said at least one window aperture.

13. A package system as defined in claim 12 further comprising organic smokable product within said box cavity, said insert base panel being substantially disposed between said organic smokable product and said at least one window aperture.

14. A package system as defined in claim 10 in which said insert lateral panels are elastically biased to return to a partially unfolded configuration, thereby applying pressure against said first and second side panels when said insert element is slideably received within said box cavity.

15. A package system as defined in claim 6 in which:

said first face panel is further defined by a fourth fold line, said fourth fold line extending generally from said third fold line to said first fold line;

said second face panel is further defined by a tenth fold line generally perpendicular to said third fold line; and said box element further comprises a first closure panel extending along said fourth fold line from approximately said first fold line to said third fold line, a second closure panel extending along said tenth fold line from approximately said fifth fold line to said eighth fold line, a first tuck flap foldedly connected to said first closure panel along an eleventh fold line and extending generally within said second distance generally along said eleventh fold line, and a second tuck flap foldedly connected to said second closure panel.

16. A package system for organic product, said package system comprising:

a box element being made of a foldable material and including (a) a first face panel being defined at least in part by a first fold line, a second fold line, a third fold line and a fourth fold line, said first and second fold lines being generally parallel to said third fold line and disposed at a first distance and a second distance respectively therefrom, said first distance being greater than said second distance by a third distance, said fourth fold line extending generally from said third fold line to said first fold line, said first face panel including at least one window aperture;

(b) a first side panel being defined at least in part by said third fold line and a fifth fold line generally parallel thereto;

(c) a pocket side panel being defined at least in part by said first fold line and a sixth fold line generally parallel thereto;

(d) a pocket face panel being defined at least in part by said sixth fold line and a seventh fold line generally parallel thereto, said sixth and seventh fold lines being spaced from one another by approximately said third distance;

(e) a first adhesion flap foldedly connected to said pocket face panel along said seventh fold line;

(f) a second adhesion flap foldedly connected to said second fold line;

(g) a second face panel defined at least in part by said fifth fold line, an eighth fold line generally parallel thereto and a tenth fold line generally perpendicular to said third fold line;

(h) a second side panel foldedly connected to said second face panel along said eighth fold line; and (i) a pocket closure flap foldedly connected to said pocket side panel along a ninth fold line, said ninth fold line being generally perpendicular to said first fold line;

(j) a first closure panel extending along said fourth fold line from approximately said first fold line to said third fold line;

(k) a second closure panel extending along said tenth fold line from approximately said fifth fold line to said eighth fold line;

(l) a first tuck flap foldedly connected to said first closure panel along an eleventh fold line and extending generally within said second distance generally along said eleventh fold line; and (m) a second tuck flap foldedly connected to said second closure panel;

wherein each pair of said panels which are defined at least in part by a common one of said fold lines are at an approximately right angle with respect to one another, said box element thereby defining a box cavity therein and a side pocket, and said first adhesion flap and said second adhesion flap are each adhesively bonded to said second side panel; and an insert element including an insert base panel, a pair of insert lateral panels oppositely disposed from one another, and an insert end panel, said insert lateral panels and said insert end panel being in folded engagement with said insert base panel, said insert element being substantially transparent and slideably removably received within said box cavity such that said insert end panel is substantially adjacent said first closure panel and said insert base panel extends across said at least one window aperture.

17. A package system as defined in claim 16 further comprising organic smokable product within said box cavity, said insert base panel being substantially disposed between said organic smokable product and said at least one window aperture.

18. A package system as defined in claim 16 in which said insert lateral panels are elastically biased to return to a partially unfolded configuration, thereby applying pressure against said first and second side panels when said insert element is slideably received within said box cavity.

19. A package system as defined in claim 16 in which said box element is made substantially of paperboard, and said insert element is made substantially of a polymer.

20. A package system for organic product, said package system comprising:

a box element including a first face panel, a second face panel, a box cavity therebetween and a pocket adapted to snuggly and protectively receive an auxiliary packet, said box cavity having a first end and a second end, said first face panel including a window aperture, said second face panel including a fold line at generally said second end, said box element further including a second closure panel extending along said fold line and a second tuck flap foldedly connected to said second closure panel generally oppositely of said fold line; and an insert element including an insert base panel, a pair of insert lateral panels oppositely disposed from one another, and an insert end panel, said insert lateral panels and said insert end panel being in folded engagement with said insert base panel, said insert element being substantially transparent and slideable with respect to said box cavity between a retracted configuration and an extended configuration, said insert element being entirely within said box cavity in said retracted configuration, said insert element extending partially outward of said second end in said extended configuration;

wherein said second closure panel and said second tuck flap are cooperatively movable into a product partitioning configuration within which said second closure panel and said second tuck flap are adapted to separate a measured quantity of the organic product to be dispensed from said insert element from a remaining quantity of the organic product to be retained within said insert element when said insert element is in said extended configuration.

* * * * *